US005215448A

United States Patent [19]

Cooper

[11] Patent Number: 5,215,448

[45] Date of Patent: Jun. 1, 1993

[54] COMBINED BOILER FEED AND CONDENSATE PUMP

[75] Inventor: Paul Cooper, Titusville, N.J.

[73] Assignee: Ingersoll-Dresser Pump Company, Liberty Corner, N.J.

[21] Appl. No.: 813,560

[22] Filed: Dec. 26, 1991

[51] Int. Cl.[5] ..... F04B 17/00; F04B 35/04

[52] U.S. Cl. ..... 417/423.5; 417/423.7; 417/423.14

[58] Field of Search ..... 417/423.5, 423.7, 423.14; 415/90, 143; 62/505

[56] References Cited

U.S. PATENT DOCUMENTS

| | | | |
|---|---|---|---|
| 3,226,012 | 12/1965 | Trask | 415/90 |
| 3,975,117 | 8/1976 | Carter | 415/143 |
| 4,523,896 | 6/1985 | Lhenry et al. | 417/244 |
| 4,932,848 | 6/1990 | Christensen | 417/423.14 |
| 4,981,420 | 1/1991 | Jensen et al. | 417/423.14 |
| 5,028,218 | 7/1991 | Jensen et al. | 417/423.7 |

*Primary Examiner*—Richard A. Bertsch
*Assistant Examiner*—Alfred Basichas
*Attorney, Agent, or Firm*—Michael H. Minns

[57] ABSTRACT

A boiler feed pump including an elongate casing adapted to be interconnected in a pipeline and a variable speed electrical motor driving an axially extending shaft, which drives a condensate inducer pump and a multiple stage centrifugal pump, all of which are housed within the casing. The inducer pump comprises a series of axially spaced rotating annular disks which the condensate flows between. The centrifugal pump receives the condensate from the inducer pump and pumps it to a higher pressure suitable for feeding a boiler. The motor can operate at a variable speed to handle various flow demands. The motor also serves as a thrust balancing device for the multiple stage centrifugal pump.

13 Claims, 3 Drawing Sheets

COMBINED BOILER FEED AND CONDENSATE PUMP

BACKGROUND OF THE INVENTION

This invention relates generally to a pump that combines the functions of a boiler feed pump and condensate pump and more particularly to a combined boiler feed pump and a condensate pump having a motor and a common shaft, and adapted to be mounted in a pipeline in an inline configuration with the motor driving the common shaft being housed entirely within the pump casing to provide a sealless pump.

The usual powerplant steam boiler system includes a feed pump for feeding water to the boiler to replace the water that is converted into steam and a separate condensate pump for extracting condensate from the condenser and placing it under pressure prior to feeding it to the feed pump. A steam condenser operates at a vacuum and the pressure in the inlet of the condensate pump is either at a very low positive pressure or a negative pressure (vacuum). The usual feed pump cannot operate properly at a low inlet pressure and therefore a condensate pump is required to create sufficient pressure on the condensate before delivering it to the inlet of the boiler feed pump.

The foregoing illustrates limitations known to exist in present steam boiler systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a pump for drawing the condensate from a condenser and feeding it to a steam boiler, comprising an elongate casing adapted to be connected in a pipeline having an inlet for receiving the condensate from a steam condenser and an outlet for feeding the condensate to a steam boiler, a pump shaft mounted in said casing with its length extending along the length of said casing and rotating in a pair of bearings spaced along said shaft and fixed in said casing, an electric motor mounted in said casing adjacent said outlet and connected to one end of said shaft for driving it, control means for operating said electric motor, an inducer pump mounted at the other end of said shaft, driven by said shaft, and a multiple stage centrifugal feed pump located in said casing driven by said shaft and receiving condensate from the inducer pump, pumping said condensate to a higher pressure suitable for feeding a steam boiler and delivering said condensate to the outlet of said pump, said inducer pump being of the type to produce sufficient positive pressure for properly feeding condensate to said feed pump.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
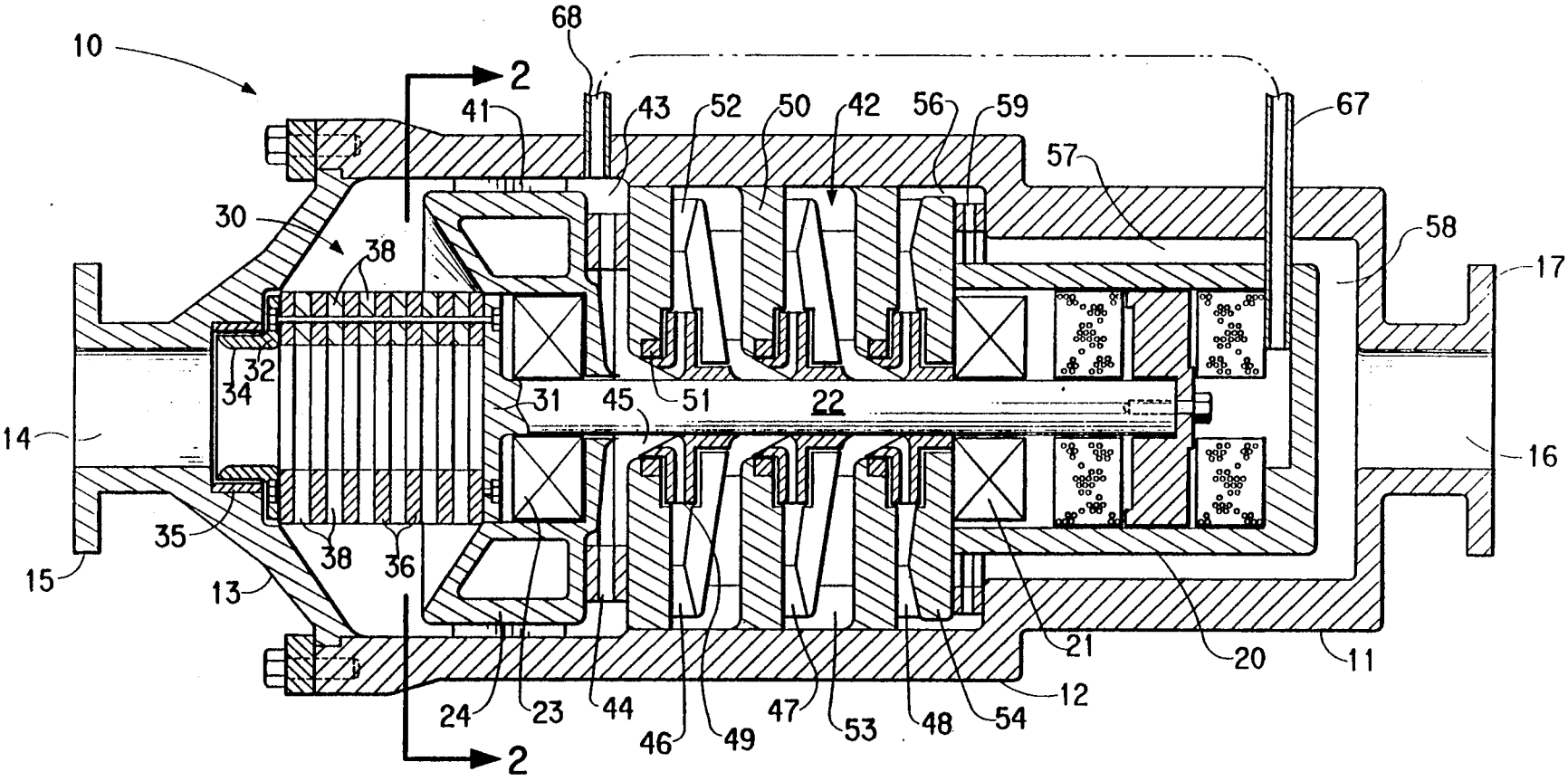
FIG. 1 is a cross-sectional view of a pump taken along the rotary axis of the pump and illustrating an embodiment of the invention.
Figure 2:
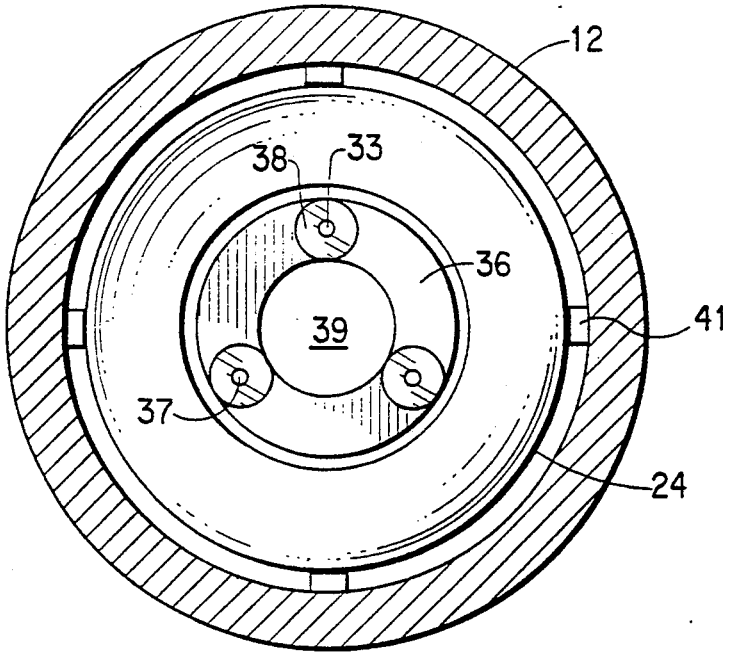
FIG. 2 is a sectional view of FIG. 1 taken along the section line 2—2 showing details of the inducer pump section of the invention.
Figure 3:
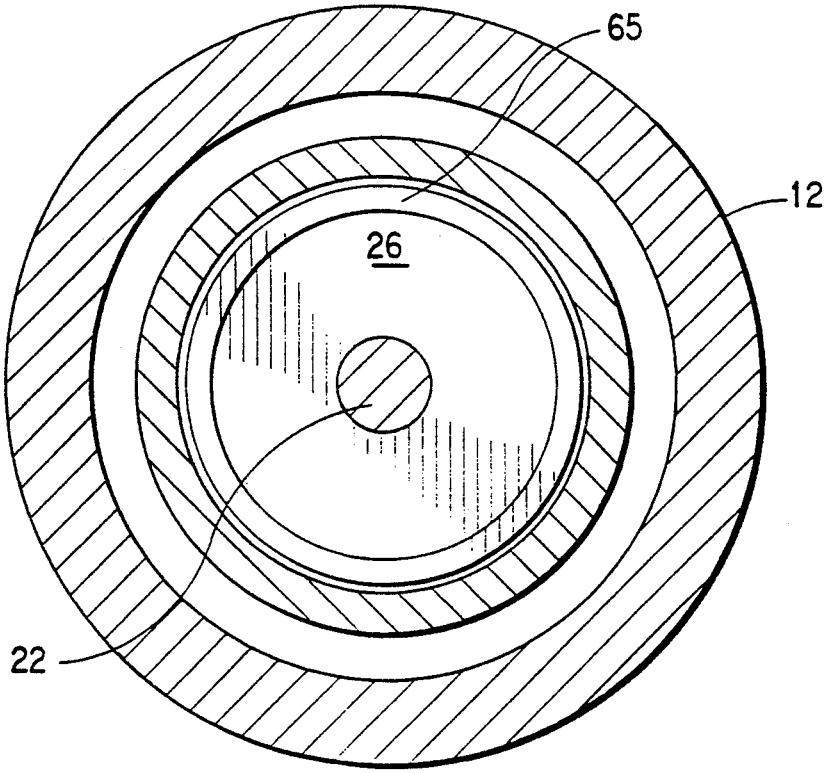
FIG. 3 is a sectional view of FIG. 1 taken along the section line 3—3 showing details of the motor in the pump of this invention.

The pump 10 shown in the drawing FIGS. includes a casing 11 comprising an elongated open-end receptacle 12 closed at its open end by a cover 13. The casing 11 is intended to be installed in a pipeline in an inline configuration, with its length extending along the length of the pipeline. The casing cover 13 includes an inlet 14 surrounded by a pipe flange 15 adapted to be connected to an adjacent pipe in a pipe line and the closed end of the casing receptacle 12 includes an outlet 16 surrounded by a pipe flange 17, similar to the inlet flange 15, adapted to be connected to an adjacent pipe in a pipe line. The casing 11 completely houses all the mechanical parts of the pump 10 and, thus, can be called a "sealless pump" because there are no rotary seals providing a potential source of leakage, such as in the conventional pumps used for the application of this invention.

The casing receptacle 12 contains an internal structure including a motor support container 20 which slidably fits in the receptacle 12 and supports a bearing 21 rotatably supporting a pump shaft 22. The opposite end of the pump shaft 22 is supported in a bearing 23 which, in turn, is supported in an annular frame 24 fitting in the receptacle 12 and engaging the sides of the receptacle 12. The shaft 22 is driven by a variable speed electric motor 25 comprising a rotor disk 26 attached to the end of the shaft 22 adjacent the bearing 21. The rotor disk 26 is located between and adjacent to a pair of annular electrical driving field coils 27. The field coils 27 are supported in the motor support container 20 and create a rotating electrical field which, through magnetism, acts to drive the rotor disk 26 in a manner well known in the art of electrical motors. The field coils 27 are connected to an electrical supply source which is not shown and contains a speed controller which serves to drive the rotor disk 26 at variable rotary speeds over a selected speed range.

An inducer pump 30 is attached to the end of the shaft 22 opposite the motor 25 and is driven by the motor 25 at the same speed. The inducer pump 30 includes a circular end plate 31 attached to the end of the shaft 22 and an axially spaced annular end plate 32 which is interconnected to the circular end plate 31 by a series of longitudinally extending bolts 33 located at spaced intervals around and adjacent to the circumference of each end plate. The annular end plate 32 includes an annular sealing flange 34 rotatably engaging a cooperating seal ring 35 mounted in the casing cover 13 adjacent the inlet 14. A series of axially spaced washer-like annular disks 36 are mounted on the longitudinally extending bolts 33, which extend through corresponding holes 37 located in the disks 36. The disks 36 are axially spaced from adjacent disks 36 by small annular spacers 38, having the appearance of small washers. The disks 36 have axial openings 39 for receiving the condensate flowing through the inlet 14 and the annular end plate 32. The condensate flows radially between the spaced disks 36 and is provided with energy from the rotating disks 36 which results in creating a positive pressure on the pumped condensate.

The pumped condensate exiting from the disks 36 flows radially outward in the casing 11 and into longitudinally extending passages 41 extending longitudinally past the annular bearing frame 24 and to the inlet of a multiple stage centrifugal pump 42. As the condensate exits from the passages 41 it flows radially inward through a circular space 43 located between the end of the annular frame 24 and the end 45 of the pump 42, before entering the pump 42. The space 43 is formed by spacing the end of the pump 42 from the end of the annular frame 24 and contains a series of axially spaced washer-like disks 44 forming velocity reducing vanes for reducing the velocity and noise of the pumped fluid flowing between such disks 44.

The centrifugal pump 42 is shown in FIG. 1 as containing 3 stages, 46, 47 and 48. The pump 42 is conventional and could contain more or less stages, depending on the application of the pump 10. Each of the stages 46, 47 and 48 contains an impeller 49 mounted on the shaft 22 and cooperating with a fixed wall 50 supporting a sealing ring 51 engaging the inlet end of the impeller 49 for sealing purposes. The fixed wall 50 for each stage includes a structure forming a diffuser 52 receiving fluid exiting from the impeller 49. In addition, the structure of the fixed wall 50 for the first and second stages 46 and 47 forms a flow reversing passage 53 for directing fluid to the next stage. The fixed wall 50 of the third stage 48 includes an end wall 54 engaging the end of the motor support container 20, shown in FIG. 1. Fluid exiting from the third stage 48 of the pump 42 flows around the circumference of the end wall 54 into a short passage or space 56 extending radially inward and then longitudinally through longitudinal passages 57 passing the exterior of the motor support container 20. At the end of the passages 57, the fluid flows inward through radial passages 58 to the outlet 16 of the pump 10, where it exits from the pump 10 into a pipeline (not shown) coupled with the pump 10.

The short passage space 56 also contains a set of longitudinally spaced disks 59, similar to the disks 44, for reducing the velocity and noise of the fluid flowing through the passage 56.

Figure 4:
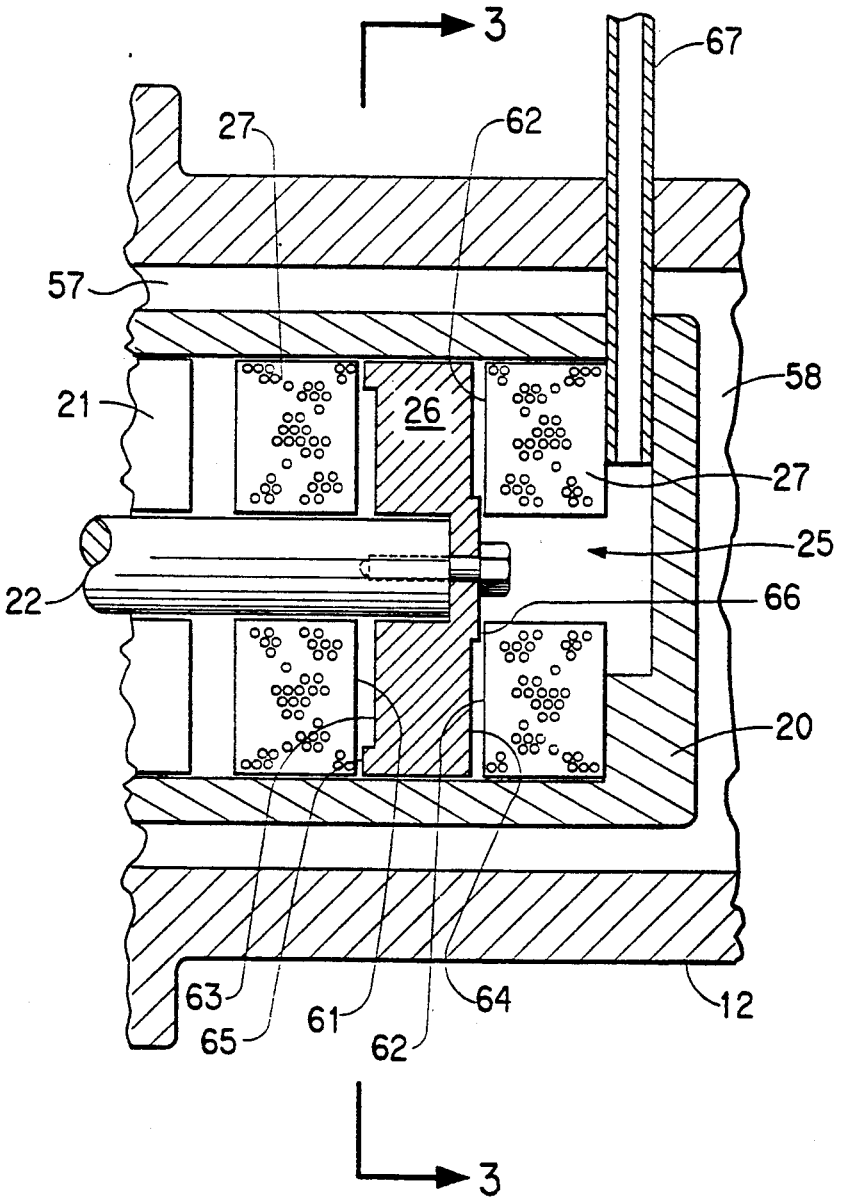
FIG. 4 is an enlarged view of a portion of FIG. 1 showing details of the motor.

Another feature of the invention is the use of the rotor disk 26 of the driving motor 25 as a thrust balancing device for the multiple stage centrifugal pump 42. Further details of the motor rotor disk 26 are shown in FIG. 4. The electrical field coils 27, sandwiching the rotor disk 26, have respective smooth flat faces 61 and 62 opposing corresponding faces 63 and 64 on the rotor disk 26. The faces 61 and 63 are located on the side of the rotor disk 26 nearest to the multiple stage pump 42 and are referred to as high pressure (hereinafter called HP) faces while the faces 62 and 64 are located on the side of the rotor disk 26 away from the pump 42 and are referred to as the low pressure (hereinafter called LP) faces. The HP rotor face 63 is flat with the exception of a raised annular lip 65 located near its periphery while the LP rotor face 64 is flat with the exception of a raised annular lip 66 located near its axis.

The portion of the motor support container 20 enclosing the field coil 27, containing the LP face 62, is exhausted by a port 67 which is piped to a port 68 opening into the space 43, containing a lower pressure, equivalent to the suction pressure of the pump 42. Consequently, the space in the container 20 adjacent the LP faces 62 and 64 is continuously exhausted and, therefore, subject to a pressure below the discharge pressure of the pump 42. On the other hand, the discharge pressure of the pump 42 continuously leaks across the bearing 21, located in the container 20 and flows to the space adjacent the HP faces 61 and 63.

It is well known that a multiple stage pump will create a high thrust force acting toward the suction end of the pump and that such high thrust force must be either carried by the bearings of the pump shaft or reduced by an opposing force. It is also conventional for this type of pump to use a balancing piston for balancing this thrust force. However, my invention is the concept of using a pump driving motor as a balancing device. Looking at FIG. 4, initially, the discharge pressure (high pressure), adjacent the HP faces 61 and 63, enters the space between such faces and acts to thrust the rotor to the right in FIG. 4. However, this discharge pressure also leaks around the periphery of the rotor 26 and enters the LP space between the LP faces 62 and 63, creating a force acting toward the left in FIG. 4, adding to the normal thrust force on the pump 42, and opposing the force created by the discharge pressure acting on the HP face 63 of the rotor 26, which will result in the total thrust forces on the pump 42 to act toward the left in FIG. 4.

If it were not for the lips 65 and 66, these opposing forces would serve no useful function. However, as the rotor 26 moves axially to the left in FIG. 4, the HP pressure lip 66 closes on the HP coil face 61 to reduce the flow of discharge pressure to the LP rotor face 64, while the LP lip on the LP rotor face 64 opens, allowing the LP rotor face 64 to come under the influence of the suction pressure created by the exhaust port 67. This movement of the rotor disk 26 allows the discharge pressure acting on the HP rotor face 63 to increase its force acting toward the right end of FIG. 4, thus opposing the normal thrust force of the pump 42. On the other hand, if the thrust force created by the discharge pressure acting on the HP rotor face 63 overcomes the normal thrust force of the pump 42 and forces the rotor disk 26 to move toward the right in FIG. 4, the HP lip 65 will open while the LP lip 66 will close on the LP coil face 62, closing off the LP rotor face 64 from the exhaust port 67, causing the discharge pressure to be applied to the LP rotor face 64 and allowing the rotor 26 to once again move toward the left in FIG. 4, thereby starting the same cycle as recited above. In this manner, the rotor disk 26 seeks a position somewhere between the coil faces 61 and 62 where the thrust forces on the pump 42 are balanced. This balanced position is automatically and continuously achieved during the operation of the pump 10.

Another feature of the pump 10 is the use of magnetic bearings. Each of the bearings 21 and 23 may be magnetic bearings of the type using magnetic forces to balance the pump shaft 22 in a balanced position within the bearings, wherein the shaft is spaced from the bearing surfaces. The use of magnetic bearings will reduce noise and friction losses.

The inducer pump 30, using the annular disks, has been found to develop satisfactory suction pressure (NPSH), which may be in the neighborhood of 100 psi, while operating in the same speed range as the multiple stage feed pump 42. It is important for the pump 42 to operate without vapor bubbles forming in the condensate, which would cause considerable damage to the pump 42 and have other undesirable results, well recognized in the pump art.

Having described the invention, what is claimed is:

1. A pump for drawing the condensate from a condenser and feeding it to a steam boiler, the combination comprising:

an elongate casing adapted to be connected in a pipeline having an inlet for receiving the condensate from a steam condenser and an outlet for feeding the condensate to a steam boiler;

a pump shaft mounted in said casing rotating in a pair of bearings spaced along said shaft and fixed in said casing;

an electric motor mounted in said casing connected to one end of said shaft for driving it;

control means for operating said electric motor;

an inducer pump mounted at the other end of said shaft, driven by said shaft;

a multiple stage centrifugal feed pump located in said casing driven by said shaft and receiving condensate from the inducer pump, pumping said condensate to a higher pressure suitable for feeding a steam boiler and delivering said condensate to the outlet of said pump, the multiple stage centrifugal feed pump being located adjacent said inducer pump; and said inducer pump being of the type to produce sufficient positive pressure for properly feeding condensate to said feed pump.

2. The pump of claim 1 wherein: said inducer pump is driven at the same speed as said multiple stage centrifugal feed pump.

3. The pump of claim 2 wherein: said inducer pump is driven at the same speed as said shaft.

4. The pump of claim 1 wherein: said inducer pump includes a set of spaced disks fixed on said shaft and being arranged with the condensate entering said pump to flow radially between the rotating disks with the surface friction of the rotating disks acting to pump the condensate radially outward between the disks.

5. The pump of claim 4 wherein: said casing wholly contains all of the mechanical parts of the pump to form a sealless pump.

6. The pump of claim 1 wherein: said motor is arranged to provide a counter thrust force on said shaft opposing the usual thrust force created by said multiple stage centrifugal feed pump.

7. A pump for drawing the condensate from a condenser and feeding it to a steam boiler, the combination comprising:

an elongate casing adapted to be connected in a pipeline in an inline configuration and having an inlet located at one of its longitudinal ends for receiving the condensate from a steam condenser and an outlet located at the other longitudinal end for feeding the condensate to a steam boiler;

a pump shaft mounted in said casing with its length extending along the length of said casing and rotating in a pair of bearings spaced along said shaft and fixed in said casing;

an electric motor mounted in said casing adjacent said outlet and connected to one end of said shaft for driving it;

control means for operating said electric motor;

an inducer pump mounted at the other end of said shaft, driven by said shaft;

a multiple stage centrifugal feed pump located in said casing driven by said shaft and receiving condensate from the inducer pump, pumping said condensate to a higher discharge pressure suitable for feeding a steam boiler and delivering said condensate to the outlet of said pump; and said inducer pump being of the type to produce sufficient positive pressure for properly feeding condensate to said feed pump.

8. The pump of claim 7 wherein: said casing wholly contains all of the mechanical parts of the pump to form a sealless pump.

9. The pump of claim 7 wherein: said inducer pump includes a set of spaced disks fixed on said shaft and being arranged with the condensate entering said pump to flow radially between the rotating disks with the surface friction of the rotating disks acting to pump the condensate radially outward between the disks.

10. A pump for drawing the condesate from a condenser and feeding it to a steam boiler, the combination comprising:

an elongate casing adapted to be connected in a pipeline in an inline configuration and having an inlet located at one of its longitudinal ends for receiving the condensate from a steam condenser and an outlet located at the other longitudinal end for feeding the condensate to a steam boiler;

a pump shaft mounted in said casing with its length extending along the length of said casing and rotating in a pair of bearings spaced along said shaft and fixed in said casing;

an electric motor mounted in said casing adjacent said outlet and connected to one end of said shaft for driving it;

control means for operating said electric motor;

an inducer pump mounted at the other end of said shaft, driven by said shaft;

a multiple stage centrifugal feed pump located in said casing driven by said shaft and receiving condensate from the inducer pump, pumping said condensate to a higher discharge pressure suitable for feeding a steam boiler and delivering said condensate to the outlet of said pump; and said inducer pump being of the type to produce sufficient positive pressure for properly feeding condensate to said feed pump, the motor including a rotor rotating between two axially spaced coils and the faces of said rotor and the coils cooperating to provide an axially directed thrust force countering the natural thrust of said multiple stage centrifugal feed pump.

11. The pump of claim 10 further comprising:

means for applying the suction pressure of said multiple stage centrifugal feed pump to one axial face of said motor rotor;

means for applying the discharge pressure of said multiple stage centrifugal feed pump to the other axial face of said motor rotor; and lips provided between the faces of said motor rotor and said coils for automatically sealing off or opening up said faces to said discharge pressure and said suction pressure as said motor rotor moves axially for automatically creating a balancing thrust force for said multiple stage centrifugal feed pump.

12. A pump for drawing the condensate from a condenser and feeding it to a steam boiler, the combination comprising:

an elongate casing adapted to be connected in a pipeline having an inlet for receiving the condensate from a steam condenser and an outlet for feeding the condensate to a steam boiler;

a pump shaft mounted in said casing rotating in a pair of bearings spaced along said shaft and fixed in said casing;

an electric motor mounted in said casing connected to one end of said shaft for driving it;

control means for operating said electric motor;

an inducer pump mounted at the other end of said shaft, driven by said shaft;

a multiple stage centrifugal feed pump located in said casing driven by said shaft and receiving condensate from the inducer pump, pumping said condensate to a higher pressure suitable for feeding a steam boiler and delivering said condensate to the outlet of said pump; and a plurality of spaced apart velocity reducing disks being located between the discharge of said inducer pump and the inlet of said multiple stage centrifugal feed pump and a plurality of spaced apart velocity reducing disks being located between the discharge of said multiple stage centrifugal feed pump and the outlet;

said inducer pump being of the type to produce sufficient positive pressure for properly feeding condensate to said feed pump.

13. A pump for drawing the condensate from a condenser and feeding it to a steam boiler, the combination comprising:

an elongate casing adapted to be connected in a pipeline having an inlet for receiving the condensate from a steam condenser and an outlet for feeding the condensate to a steam boiler;

a pump shaft mounted in said casing rotating in a pair of bearings spaced along said shaft and fixed in said casing;

an electric motor mounted in said casing connected to one end of said shaft for driving it;

control means for operating said electric motor;

an inducer pump mounted at the other end of said shaft, driven by said shaft; and a multiple stage centrifugal feed pump located in said casing driven by said shaft and receiving condensate from the inducer pump, pumping said condensate to a higher pressure suitable for feeding a steam boiler and delivering said condensate to the outlet of said pump;

said inducer pump being of the type to produce sufficient positive pressure for properly feeding condensate to said feed pump, said motor including a means for providing a self-compensating counter thrust force on said shaft to oppose the usual thrust force created by said multiple stage centrifugal feed pump.

* * * * *